US011685627B2

(12) United States Patent
Mio et al.

(10) Patent No.: US 11,685,627 B2
(45) Date of Patent: Jun. 27, 2023

(54) POST-PROCESSING APPARATUS AND IMAGE FORMING SYSTEM

(71) Applicant: Ricoh Company, Ltd., Tokyo (JP)

(72) Inventors: Natsuki Mio, Kanagawa (JP); Yasuki Matsuura, Kanagawa (JP); Akiyoshi Irie, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/363,926

(22) Filed: Jun. 30, 2021

(65) Prior Publication Data

US 2022/0017322 A1 Jan. 20, 2022

(30) Foreign Application Priority Data

Jul. 20, 2020 (JP) ..... 2020-123810

(51) Int. Cl.
*B65H 37/06* (2006.01)

(52) U.S. Cl.
CPC ..... *B65H 37/06* (2013.01)

(58) Field of Classification Search
CPC ..... B65H 2301/51611
See application file for complete search history.

(56) References Cited

U.S. PATENT DOCUMENTS

2006/0055100 A1* 3/2006 Suzuki ..... B42C 1/12 270/45
2009/0129840 A1 5/2009 Takekawa et al.
2010/0007072 A1* 1/2010 Kamiya ..... G03G 15/6552 270/37
2016/0091856 A1 3/2016 Irie et al.
2016/0313687 A1* 10/2016 Osada ..... B42C 3/00
2020/0172363 A1* 6/2020 Ueno ..... B65H 31/34
2020/0172368 A1 6/2020 Susaki et al.
2020/0231399 A1 7/2020 Shibata et al.

FOREIGN PATENT DOCUMENTS

EP 2096068 A2 * 9/2009 ..... B65H 37/04
JP 2014-097895 5/2014
JP 2017-149495 8/2017

* cited by examiner

*Primary Examiner* — Jennifer Bahls
(74) *Attorney, Agent, or Firm* — Xsensus LLP

(57) ABSTRACT

The aligning device receives a sheet conveyed in a sheet conveyance direction in a stackable manner and aligns a position of the sheet in the sheet conveyance direction. The moving mechanism moves the sheet aligned by the aligning device in the sheet conveyance direction together with the aligning device. The controller selectively executes a first mode in which first post-processing is performed on the sheet and then second post-processing is performed on the sheet and a second mode in which the second post-processing is performed on the sheet without performing the first post-processing on the sheet. The controller, in response to a selection of the first mode or the second mode, causes the moving mechanism to adjust a position of the aligning device in the sheet conveyance direction before the aligning device receives the sheet as a target of the first post-processing or the second post-processing, respectively.

20 Claims, 9 Drawing Sheets

POST-PROCESSING APPARATUS AND IMAGE FORMING SYSTEM

CROSS-REFERENCE TO RELATED APPLICATION

This patent application is based on and claims priority pursuant to 35 U.S.C. § 119(a) to Japanese Patent Application No. 2020-123810, filed on Jul. 20, 2020, in the Japan Patent Office, the entire disclosure of which is hereby incorporated by reference herein.

BACKGROUND

Technical Field

Embodiments of the present disclosure relate to a post-processing apparatus that performs post-processing on a sheet, and an image forming system including an image forming apparatus such as a copying machine, a printer, a facsimile machine, a multifunction peripheral (MFP) thereof, and a printing machine.

Description of the Related Art

There is known a post-processing apparatus connected to an image forming apparatus such as a copying machine or a printer, which performs a plurality of post-processes such as a binding process (a saddle-stitching process and a center-folding process) on a sheet.

There is also known a technology in which, when binding process is performed, ends of sheets are aligned at a predetermined position before saddle-stitching process, and then the aligned sheets are moved to a position at which saddle-stitching process is performed, and saddle-stitching process is performed.

SUMMARY

In an aspect of the present disclosure, a post-processing apparatus includes an aligning device, a moving mechanism, and a controller. The aligning device receives a sheet conveyed in a sheet conveyance direction in a stackable manner and aligns a position of the sheet in the sheet conveyance direction. The moving mechanism moves the sheet aligned by the aligning device in the sheet conveyance direction together with the aligning device. The controller selectively executes a first mode in which first post-processing is performed on the sheet and then second post-processing is performed on the sheet and a second mode in which the second post-processing is performed on the sheet without performing the first post-processing on the sheet. The controller, in response to a selection of the first mode, causes the moving mechanism to adjust a position of the aligning device in the sheet conveyance direction before the aligning device receives the sheet as a target of the first post-processing. The controller, in response to a selection of the second mode, causes the moving mechanism to adjust the position of the aligning device in the sheet conveyance direction before the aligning device receives the sheet as a target of the second post-processing.

In another aspect of the present disclosure, an image forming system includes an image forming apparatus to form an image on a sheet and the post-processing apparatus to perform post-processing on the sheet on which the image has been formed by the image forming apparatus.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
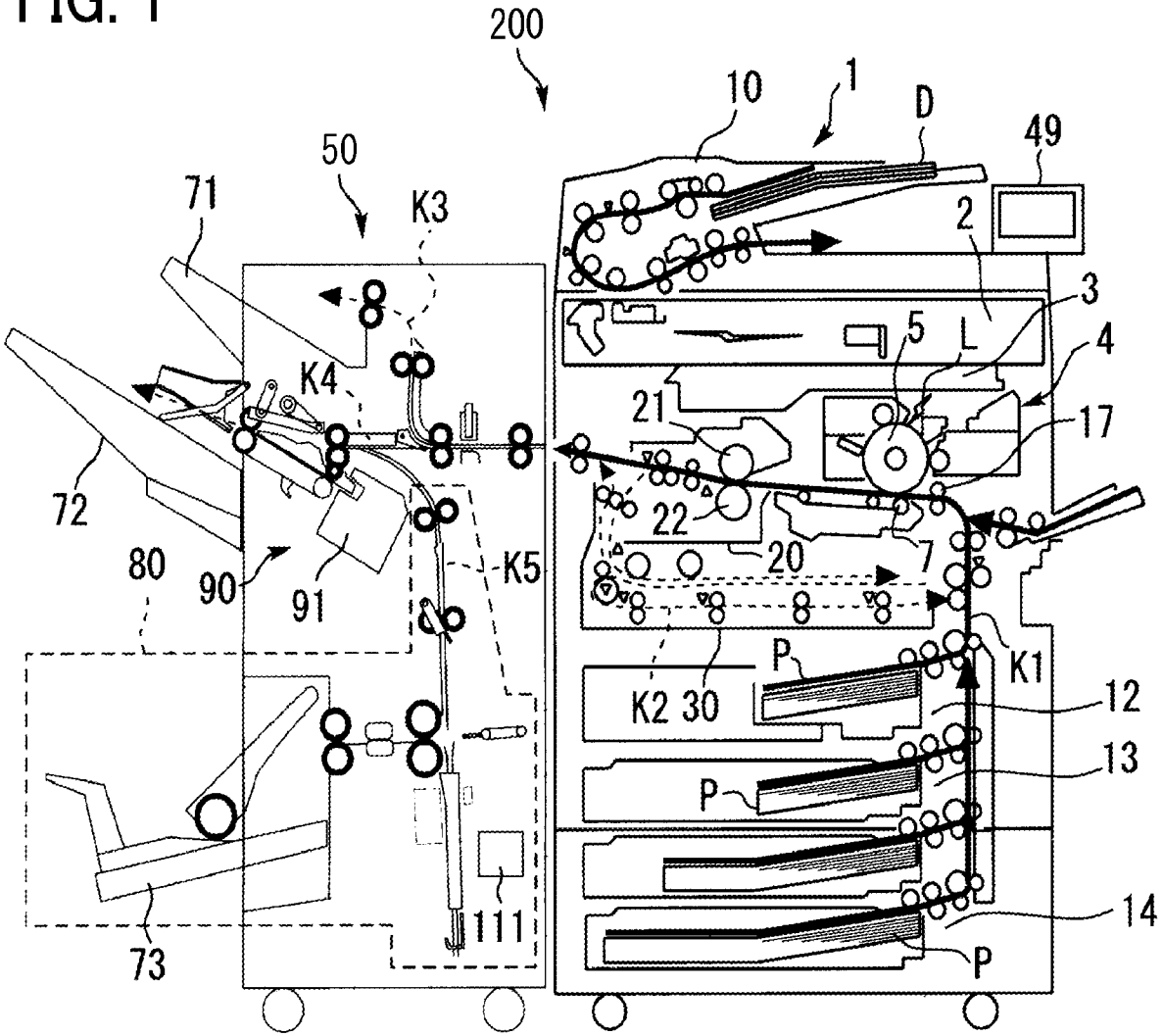
FIG. 1 is a diagram illustrating an overall configuration of an image forming system according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Hereinafter, embodiments according to the present disclosure are described in detail with reference to the drawings. In the drawings, like reference numerals denote like components and redundant or overlapping descriptions of those components may be simplified or omitted as appropriate.

First, an overall configuration and operation of an image forming system 200 is described with reference to FIG. 1.

In embodiments of the present disclosure, an image forming apparatus 1 includes a post-processing apparatus 50 detachably installed and connected with the image forming apparatus 1, and constitutes the image forming system 200 together with the post-processing apparatus 50.

In FIG. 1, the image forming apparatus 1 functioning as a copier includes a document reading device 2 that optically reads image data of a document D, and an exposure device 3 that irradiates a photoconductor drum 5 with exposure light L based on the image data read by the document reading device 2.

Further, the image forming apparatus 1 includes following components: an image forming device 4 that forms a toner image on the photoconductor drum 5, a transfer device 7 (image forming device) that transfers the toner image formed on the photoconductor drum 5 onto a sheet P, a document conveyance device 10 that conveys the document D placed on the document reading device 2, a plurality of sheet feeding units 12, 13, and 14 in which sheets P such as sheets of paper are stored, a registration roller pair 17 (timing roller pair) that conveys the sheet P toward the transfer device 7, a fixing device 20 for fixing an unfixed image on the sheet P, a fixing roller 21 provided for the fixing device 20, and a pressure roller 22 provided in the fixing device 20.

The image forming apparatus 1 further includes: a double-sided conveyance device 30 for reversing the sheet P having an image formed on the front surface of the sheet P and conveying the sheet P toward the transfer device 7, an operation display panel 49 for displaying information relating to a printing operation (image forming operation) and a post-processing operation and for performing operations, a post-processing apparatus 50 that performs post-processing on the sheet P ejected from the image forming apparatus 1 and conveyed into the post-processing apparatus 50, a first ejection tray 71, a second ejection tray 72, a third ejection tray 73 on which the post-processed sheet P (or sheet bundle) is ejected and stacked, a binding device 80 installed inside the post-processing apparatus 50, an edge-binding device 90 installed inside the post-processing apparatus 50, and a temperature and humidity sensor 111 to detect surrounding environment (ambient temperature and humidity) of the post-processing apparatus 50.

With reference to FIG. 1, a description is given of the image forming operation (or printing operation) under normal operating conditions performed by the image forming apparatus 1 of the image forming system 200.

First, the document D is conveyed from the document table in the direction indicated by arrow in FIG. 1 by the conveyance rollers of the document conveyance device 10 and the document D passes over the document reading device 2. At this time, the document reading device 2 optically reads the image data of the document D passing above the document reading device 2.

The optical image data that is read by the document reading device 2 is converted into an electric signal and then transmitted to the exposure device 3 (writing device). Then, the exposure light L such as laser light based on the image data of the electric signal is emitted from the exposure device 3 toward the photoconductor drum 5 of the image forming device 4.

On the other hand, in the image forming device 4, the photoconductor drum 5 rotates in a clockwise direction in FIG. 1, and an image (toner image) corresponding to the image data is formed on the photoconductor drum 5 through predetermined image forming processes including charging step, exposure step, and developing step.

Thereafter, the image that is formed on the photoconductor drum 5 is transferred onto the sheet P conveyed by the registration roller pair 17 in the transfer device 7 as an image forming device.

On the other hand, the sheet P that is conveyed to the transfer device 7 (image forming device) operates as follows.

First, one of a plurality of sheet feeding units 12, 13, and 14 of the image forming apparatus 1 is automatically or manually selected. For example, the uppermost sheet feeding unit 12 may be selected.

Then, the uppermost one of the sheets P, which are stored in the sheet feeding unit 12, is conveyed toward a conveyance path K1.

Thereafter, the sheet P passes through the conveyance path K1 in which a plurality of conveyance rollers is disposed, and reaches the position of the registration roller pair 17. Then, the sheet P that has reached the position of the registration roller pair 17 is conveyed toward the transfer device 7 (image forming device) at a timing matched with the image formed on the photoconductor drum 5 to align the sheet P with the image formed on the photoconductor drum 5.

After the transferring processes are complete, the sheet P passes through the position of the transfer device 7 and then reaches the fixing device 20 via the conveyance path K1. The sheet P that has reached the fixing device 20 is fed between the fixing roller 21 and the pressure roller 22, and the image is fixed by the heat received from the fixing roller 21 and the pressure received from the fixing roller 21 and the pressure roller 22. The sheet P on which the image has been fixed is sent out from a nip between the fixing roller 21 and the pressure roller 22, and then ejected from the image forming apparatus 1.

When a "double-sided printing mode" in which printing is performed on both sides (a front side and a back side) of the sheet P is selected, the sheet P having undergone the fixing step on the front side is guided to a double-sided conveyance path K2 and is conveyed again toward the transfer device 7 (image forming device) after the sheet conveyance direction of the sheet P is reversed by a double-sided conveyance device 30. When a "single-sided printing mode" is selected, the sheet P is ejected as it is. An image is formed on the back side of the sheet P in the transfer device 7 by an image forming process similar to the image forming process described above. Thereafter, the sheet P goes through a fixing step in the fixing device 20 and passes through the conveyance path K2, and is ejected from the image forming apparatus 1.

In the present embodiment, the post-processing apparatus 50 is connected to the image forming apparatus 1, the sheet P ejected from the image forming apparatus 1 is conveyed to the post-processing apparatus 50, and post-processing is performed on the conveyed sheet P.

With reference to FIG. 1, the post-processing apparatus 50 according to the present embodiment conveys the sheet P conveyed from the image forming apparatus 1 to any one of three conveyance paths K3, K4, and K5 and performs different post-processing. The conveyance path K3 that serves as a first conveyance path in the post-processing apparatus 50 is a conveyance path through which the sheet P conveyed from the image forming apparatus 1 is ejected to the first ejection tray 71 without going through any post-processing. The second conveyance path K4 is a conveyance path for stacking the sheets P conveyed from the image forming apparatus 1 on an inner tray 61, performing a binding process on rear ends of the sheets P by a binding unit 91 of the edge binding device 90, and discharging the processed sheets P (sheet bundle PT) from an ejection port 50*b* toward the second ejection tray 72 by the ejection rollers 54. The third conveyance path K5 is a conveyance path for temporarily conveying the sheet P conveyed from the image forming apparatus 1 to the second conveyance path K4 and switching back the sheet P. Thereafter, the sheet P is saddle-stitched at a center portion of the sheet P by a saddle-stitching device 81 of the binding device 80 or center-folded by the center-folding unit 87 and placed on the third ejection tray 73.

Figure 2:
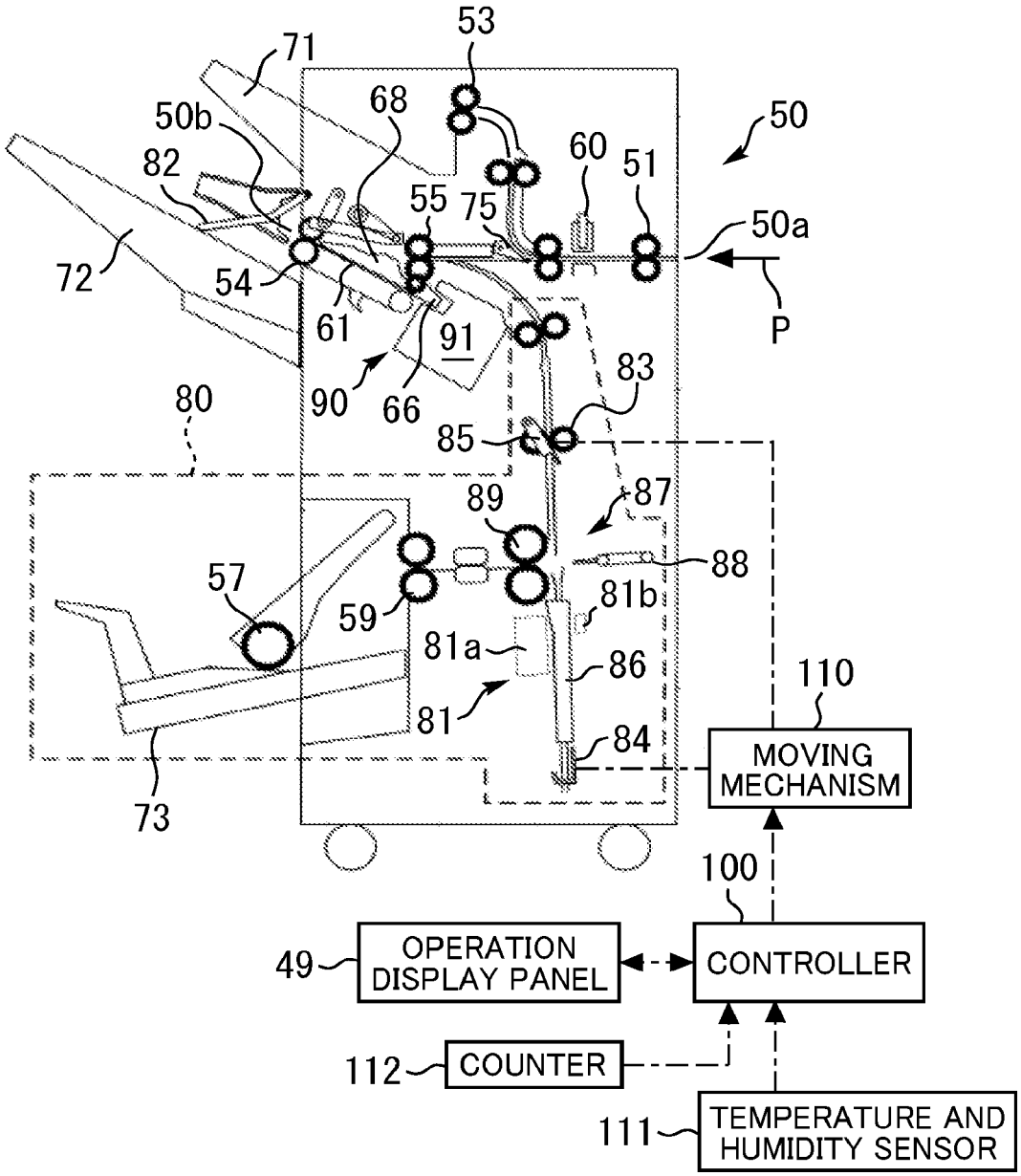
FIG. 2 is a diagram illustrating a post-processing apparatus of an image forming system according to an embodiment of the present disclosure.

The switching of the three conveyance paths K3 to K5 described above is performed by a switching operation (rotation) of a branching claw 75 (see FIG. 2).

More specifically, referring to FIG. 2, a first conveyance roller 51 and a sheet detection sensor are provided in the vicinity of a carry-in port 50*a* of the post-processing apparatus 50, and the sheet P that is detected by the sheet detection sensor is conveyed into the apparatus 50 by the conveyance roller 51. Then, based on the operation mode of the post-processing selected by the user in advance, the branching claw 75 rotates so that the sheet P is guided to the desired one of the conveyance path K3, K4, and K5.

When the mode in which no post-processing is to be performed is selected, the sheet P that is conveyed to the first conveyance path K3 is ejected by the ejection roller pair 53 and is placed on the first ejection tray 71.

On the other hand, in a case in which "punching process" is selected on the operation display panel 49 by the user, when the sheet P passes through the punching process portion 60, the punching process portion 60 performs the punching process on the sheet P.

When the "sort mode" is selected, the sheet P that is conveyed to the second conveyance path K4 is conveyed while being shifted in the sheet width direction by a predetermined amount for each sheet P by the shift roller pair 55 configured to be movable in the sheet width direction (direction perpendicular to the width direction of FIG. 2), and is further conveyed to the ejection roller 54, and is sequentially stacked on the second ejection tray 72.

With reference to FIG. 2, a feeler 82 is provided above the second ejection tray 72 so as to be rotatable about a support shaft at an upper end thereof, and the second ejection tray 72 is configured so as to be movable up and down by an elevating mechanism. Then, the height of the sheets P stacked on the second ejection tray 72 is recognized by detecting a state in which the center portion in the sheet conveyance direction of the sheet P sequentially stacked on the second ejection tray 72 is in contact with the feeler 82 by a sensor installed in the vicinity of the support shaft of the feeler 82. The vertical position of the second ejection tray 72 is adjusted in accordance with an increase or decrease in the number of sheets P stacked on the second ejection tray 72. When the vertical position of the second ejection tray 72 reaches the lower limit position, it is determined that the number of sheets P stacked on the second ejection tray 72 reaches the upper limit (full), and a stop signal is transmitted from the post-processing apparatus 50 to the image forming apparatus 1 to stop the image forming operation.

When the "end portion stapling mode" is selected, the sheets P conveyed to the second conveyance path K4 are sequentially stacked on the inner tray 61 without being shifted by the shift roller pair 55. Each time a sheet P or the sheet bundle PT is placed on the inner tray 61, the sheet P is conveyed toward the end fence 66 by the conveying roller. As a result, the trailing ends (trailing ends in the sheet conveyance direction) of the plurality of sheets P or the sheet bundle PT abut against the end fence 66, and the positions of the plurality of sheets P in the sheet conveyance direction are aligned.

At this time, the jogger fences 68 (side fences) provided at both ends in the sheet width direction of the inner tray 61 move in the sheet width direction so as to sandwich the sheet P or the sheet bundle PT every time the sheet P is placed on the inner tray 61 (or after a desired number of sheets P are stacked), and the position of the sheet P or the sheet bundle PT in the sheet width direction is aligned. Then, the trailing edge of the sheet P or the sheet bundle PT aligned in the sheet conveyance direction and the sheet width direction is subjected to the binding process by the edge binding unit 91.

Thereafter, the sheet P or the sheet bundle PT subjected to the binding process is conveyed obliquely upward along the inclined surface of the inner tray 61, is ejected to the outside by the conveyance by the ejection roller 54, and is placed on the second ejection tray 72.

In addition, in a case in which "binding mode (saddle-stitching process and center-folding mode)" is selected, referring to FIG. 2, the sheet P is first conveyed to the second conveyance path K4, is switched back by reversely rotating the shift roller pair 55 in a state in which the rear end portion of the sheet P is nipped by the shift roller pair 55, and is conveyed to the third conveyance path K5. Then, the sheet P conveyed to the third conveyance path K5 is conveyed to the position of the binding device 80 by a plurality of conveying roller pairs. Specifically, the sheet P is conveyed to a position at which the central portion of the sheet P faces the saddle-stitching device 81, which is a position at which a conveyance guide plate functions as an inner tray. Then, after a desired number of sheets P or the sheet bundle PT are stacked at the position, a binding process (saddle-stitching process) is performed on a central portion of the sheet bundle PT by the saddle-stitching device 81. Thereafter, the plurality of sheets P or the sheet bundle PT subjected to the saddle-stitching process are conveyed to a position at which the central portion of the sheet bundle PT faces the folding blade 88 by the movement of the end fence 84 and the claw 85 as the aligning device by a moving mechanism 110.

At this time, a leading end of the sheet bundle PT abuts against the end fence 84, and the position of the sheet bundle PT in the sheet conveyance direction is aligned. In addition, side fences 86 that are provided at both ends in the sheet width direction of the inner tray 61 move in the sheet width direction so as to sandwich the sheet P or the sheet bundle PT every time the sheet P is placed on the inner tray 61 (or after a desired number of sheets P are stacked), and the position of the sheet P or the sheet bundle PT in the sheet width direction is aligned.

Then, the sheet bundle PT is subjected to a folding process (center-folding process) in a state in which a center portion Pm (see FIGS. 3A, 3B, 3C, 3D, 4A and, 4B) is folded by the folding blade 88 moving to the left in FIG. 2, by being nipped and conveyed by the folding roller pair 89 with the folding portion (center portion Pm) as the leading end of the sheet bundle PT. Thereafter, the sheet bundle PT on which the center-folding process has been performed is conveyed by the ejection roller pair 59 and placed on the third ejection tray 73. Note that, similar to the second ejection tray 72, the third ejection tray 73 is also vertically movable by a lifting mechanism and is lowered in accordance with the number of sheets P of the sheet bundles PT stacked on the third ejection tray 73.

In this way, a series of binding mode (saddle-stitching process and center-folding process) are completed.

The configuration and operation of the binding device 80 are described in further detail later with reference to FIGS. 3A, 3B, 3C, 3D, 4A, 4B, 5, and 6 and the like.

Further, in the present embodiment, in addition to the "binding mode" in which the trimming process is performed after the saddle-stitching process, "folding mode" in which only the center-folding process is performed without performing the saddle-stitching process can be selected, which will also be described in detail later.

The user operates the operation display panel 49 of the image forming apparatus 1 to select one of the above-described various post-processing modes.

In the post-processing apparatus 50, the above-described various modes are executed by a controller 100 installed in the post-processing apparatus 50 (or in the image forming apparatus 1).

Hereinafter, the configuration and operation of the post-processing apparatus 50 according to the present embodiment is described in detail.

As described above with reference to, for example, FIG. 2, the post-processing apparatus 50 according to the present exemplary embodiment includes the binding device 80 for performing binding process (saddle-stitching process and center-folding process) on sheets P (a plurality of sheets P) printed by the image forming apparatus 1.

The binding device 80 includes the saddle-stitching device 81, the center-folding unit 87, aligning devices including an end fence 84 and a claw 85, and the moving mechanism 110.

With reference to, for example, FIGS. 2, 3A, 3B, and 3C, the saddle-stitching device 81 includes a driver 81*a* and a clincher 81*b* across the conveyance path.

The driver 81*a* holds staples to be stricken into the sheet bundle PT including a plurality of sheets P. The needles held by the driver 81*a* are sequentially supplied from refills (staple cartridges) by push-out teeth that move by being driven by a drive motor.

The clincher 81*b* faces the driver 81*a* via the sheet bundle PT and deforms staples stricken into the sheet bundle PT. The clincher 81*b* is driven by the drive motor to move toward and away from the driver 81*a*.

Figure 3A:
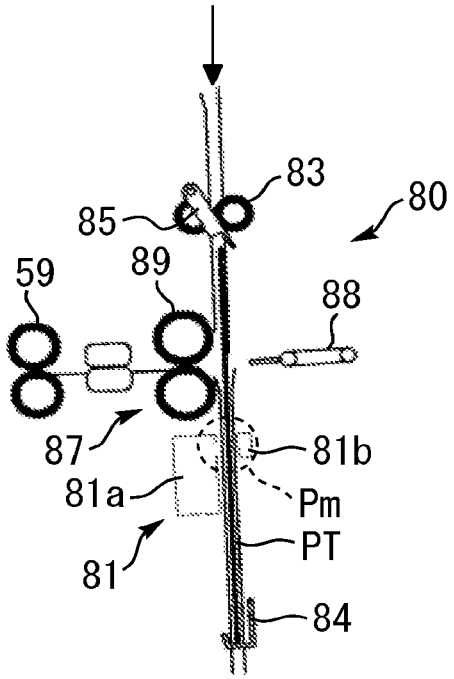
FIGS. 3A, 3B, 3C, and 3D are schematic diagrams illustrating operations of a post-processing apparatus in a binding mode according to an embodiment of the present disclosure.

The clincher 81*b* is driven by the drive motor and moves toward the driver 81*a* via the sheet bundle PT and presses against the staples held by the driver 81*a* in a state in which the staples penetrate the sheet bundle PT. Thus, substantially U-shaped tip ends of the staples are bent and penetrated through the sheet bundle PT in a center portion of the sheet bundle PT. Such a configuration as illustrated in FIG. 3A allows the center portion Pm of the sheet bundle PT to be bound by staples X.

Figure 3B:
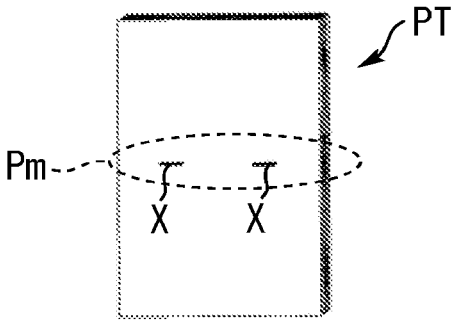
Figure 3C:
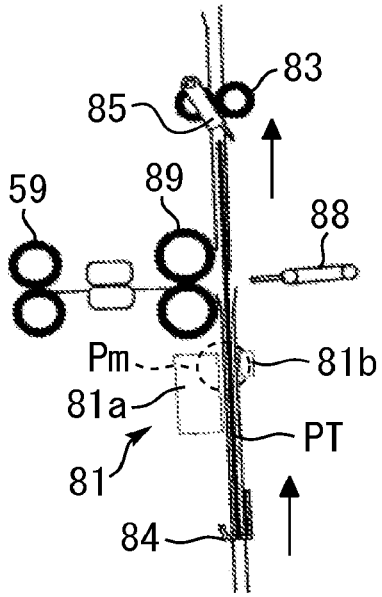
Figure 3D:
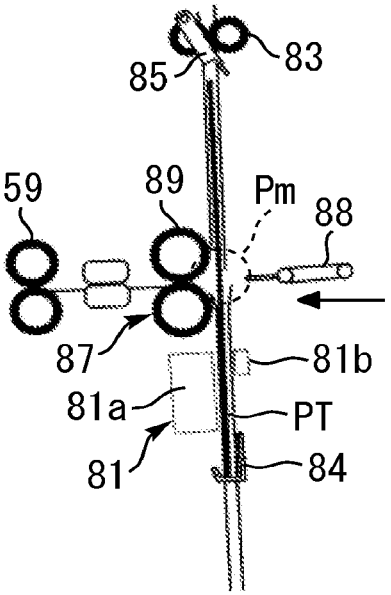
Figure 4A:
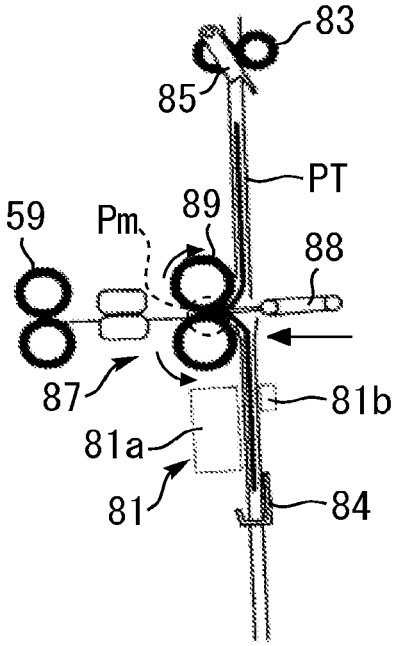
FIGS. 4A and 4B are schematic diagrams illustrating operations following the operations of FIGS. 3A, 3B, 3C, and 3D of a post-processing apparatus according to an embodiment of the present disclosure.
Figure 4B:
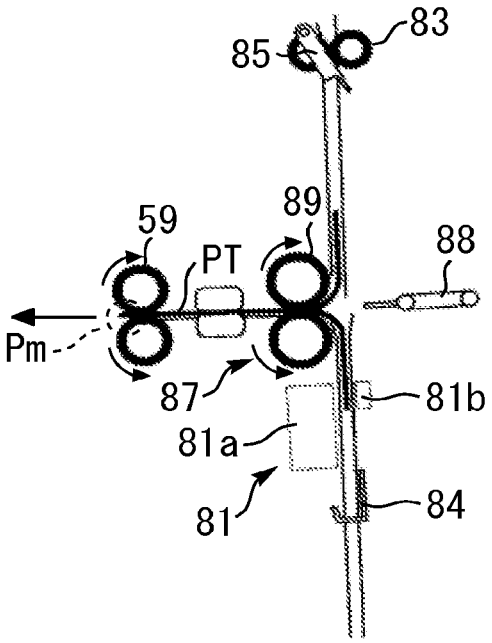
Figure 5:
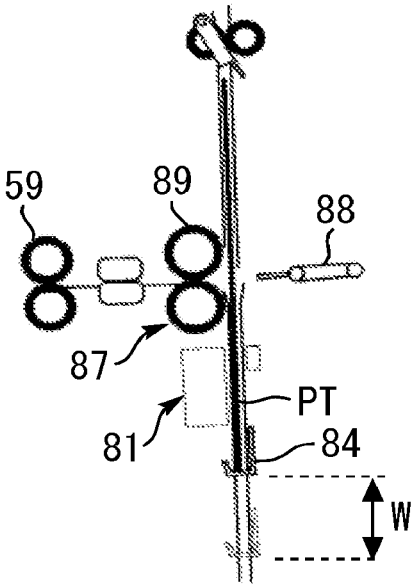
FIG. 5 is a diagram illustrating a positional difference of an end fence when a saddle-stitching process is shifted to a center-folding process according to an embodiment of the present disclosure.

With reference to, for example, FIGS. 2, 4A, and 4B, the center-folding unit 87 is disposed upstream in the sheet conveyance direction (upper side in FIG. 3) with respect to the saddle-stitching device 81. The center-folding unit 87 mainly includes a folding blade 88 and a folding roller pair 89.

As illustrated in FIG. 4A, the folding blade 88 is a blade-shaped member that pushes the central portion Pm of the sheet P including the sheet bundle PT when performing the center-folding process. The folding blade 88 is movable in the left-right direction in FIG. 4 by a moving unit, for example, a rack and pinion mechanism, controlled by the controller 100.

As illustrated in FIGS. 4A and 4B, the folding roller pair 89 is a pair of rollers that conveys the sheet P including the sheet bundle PT pushed by the folding blade 88 while nipping the sheet P with the center portion Pm of the sheet P as the leading edge of the sheet P. The folding roller pair 89 is rotatable in a direction indicated by arrows in FIGS. 4A and 4B by a motor controlled by the controller 100.

Then, as illustrated in FIGS. 4A and 4B, the sheet bundle PT is pushed into the nip of the folding roller pair 89 by the folding blade 88. Thus, a fold is formed at the center portion Pm of the sheet bundle PT by the nipping and conveying of the folding roller pair 89 to perform the center-folding process.

With reference to, for example, FIGS. 2, 3A, 3B, 3C, 4A, and 4B, the end fence 84 and the claw 85 as aligning devices are mechanisms for receiving the sheets P conveyed in a predetermined conveyance direction, which is the direction of the arrow in FIG. 3A, in a stackable manner and aligning the positions (postures) of the sheets P including the sheet bundle PT in the sheet conveyance direction.

The aligning devices includes mainly the end fence 84 and the claw 85. The end fence 84 and the claw 85 as the aligning device are held by a housing of the post-processing apparatus 50 so as to be movable in the sheet conveyance direction which is a vertical direction in FIGS. 2, 3A, 3C and 3D.

As illustrated in FIG. 3A, the end fence 84 is a fence-shaped member against which the leading edge of the sheet P in the sheet conveyance direction abuts.

The claw 85 is a member that pushes or strikes the rear end in the sheet conveyance direction of the sheet bundle P in a state in which the rear end of the sheet P in the sheet conveyance direction abuts against the end fence 84, toward the end fence 84. The claw 85 is rotatable about a support shaft. Then, when the sheet P passes through the position of the claw 85, the claw 85 is rotated to a retreat position at which the claw 85 does not interfere with the sheet P. When the sheet P is aligned during a sheet alignment process, the sheet P is rotated to a pressed position at which the rear end of the sheet P is pressed. Further, the claw 85 repeatedly rotates in the forward and reverse directions at a minute angle about the support shaft so as to repeatedly strike the rear end of the sheet P downward during the sheet alignment process.

With reference to FIG. 2, the moving mechanism 110 moves the sheets P including the sheet bundle PT aligned by the end fence 84 and the claw 85 as the aligning device in the sheet conveyance direction together with the end fence 84 and the claw 85.

Specifically, the moving mechanism 110 moves the end fence 84 and the claw 85 in the sheet conveyance direction which is the vertical direction in FIG. 3. The moving mechanism 110 vertically moves the end fence 84 and the claw 85 which sandwich the aligned sheet P, and vertically moves the end fence 84 and the claw 85 which do not sandwich the sheet P.

As the moving mechanism 110, for example, a rack and pinion mechanism can be used.

In addition, the moving mechanism 110 according to the present embodiment is capable of vertically moving the end fence 84 and the claw 85 independently to perform an alignment process as an alignment operation on the sheets P having different sizes in the sheet conveyance direction. Specifically, in a case in which the alignment process is performed on the sheet P having a large size in the sheet conveyance direction, the moving mechanism 110 is controlled such that the interval between the end fence 84 and the claw 85 in the sheet conveyance direction is longer than an interval of a case in which the alignment process is performed on the sheet P having a small size in the sheet conveyance direction.

With reference to FIG. 2, the aligning devices according to the present embodiment includes the side fences 86 that moves in the width direction, which is the direction perpendicular to the width of FIG. 2, orthogonal to the sheet conveyance direction to align the position or posture of the sheet P in the sheet width direction. Accordingly, in the present embodiment, the side fences 86 is held by the housing of the post-processing apparatus 50 so as to be movable in the vertical direction in FIG. 2.

The moving mechanism 110 in the present embodiment is able to move the side fences 86 in the sheet conveyance direction together with the end fence 84 and the claw 85.

With such a configuration, the sheets P including the sheet bundle PT stacked on the aligning devices move up and down while appropriately maintaining a state in which the sheets P are aligned in the sheet width direction in addition to a state in which the sheets P are aligned in the sheet conveyance direction.

The side fences 86 are provided at both ends in the sheet width direction of the sheets P. Each time a sheet P is placed on the aligning devices or after a desired number of sheets P are stacked, the pair of side fences 86 moves in the sheet width direction so as to sandwich the sheet P or the sheet bundle PT. Thus, the position of the sheet P or the sheet bundle PT is aligned in the sheet width direction.

In the present embodiment, as illustrated in, for example, FIGS. 3A, 3B, 3C, and 3D, a conveyance roller pair 83 is provided in the vicinity of the claw 85.

In the present embodiment, when the conveyance roller pair 83 interferes with the sheet P moving in the vertical direction together with the end fence 84 and the claw 85 by the moving mechanism 110, the conveyance roller pair 83 can also move in the vertical direction in the same manner as illustrated in FIGS. 3B and 3C.

The binding device 80 of the post-processing apparatus 50 according to the present embodiment is capable of selecting either a first mode or a second mode. In the first mode, which is an alignment mode, the sheet P is saddle-stitched as a first post-processing. Then, the sheet P is center-folded in the second mode as a second post-processing in which the sheet P is not saddle-stitched, i.e., the first post-processing.

Hereinafter, the first mode is referred to as an "alignment mode" and the second mode is referred to as a "center-folding mode", as needed.

As described above with reference to FIGS. 2, 3A, 3B, 3C, 3D, or the like, the "alignment mode" is a mode in which the saddle-stitching process, which is a process of binding the central portions Pm of the plurality of sheets P, is performed on the sheet bundle PT and then the center-folding process, which is a process of folding the central portions Pm of the sheets P, is performed.

On the other hand, the "center-folding mode" is a mode in which only the center-folding process is performed without performing the saddle-stitching process.

In the present embodiment, when the binding mode, i.e., the first mode is selected, the positions of the end fence 84 and the claw 85 as the aligning device in the sheet conveyance direction are adjusted by the moving mechanism 110 before the sheets P as a target of the saddle-stitching process, i.e., the first post-processing are received by the end fence 84 and the claw 85.

In other words, as illustrated in FIG. 3A, the position of the end fence 84 or the claw 85 in the vertical direction is moved to an optimum position, which is a position at which the center portion Pm of the sheet P faces the binding position of the saddle-stitching device 81 by the moving mechanism 110, and after the position is fixed when the movement is stopped, the sheet P is received by the end fence 84 and the claw 85 that serves as the aligning device of the saddle-stitching device 81. The end fence 84 and the claw 85 as the aligning device including the side fences 86 perform alignment process on the sheet bundle PT in the sheet conveyance direction and the sheet width direction, and then the saddle-stitching device 81 performs saddle-stitching process.

Then, as illustrated in FIGS. 3B and 3C, after the saddle-stitching process as the first post-processing is performed on the sheets P received and aligned by the end fence 84 and the claw 85 as the aligning device and before the center-folding process as the second post-processing is performed on the sheets P, the moving mechanism 110 moves the saddle-stitched sheets P together with end fence 84 and the claw 85.

That is, the saddle-stitching process is performed by the saddle-stitching device 81 on the sheet bundle PT aligned by the end fence 84, the claw 85, and the side fence 86. Thereafter, the end fence 84, the claw 85, and the side fences 86 are moved upward together with the sheet bundle PT by the moving mechanism 110 so that the central portion Pm of the sheet bundle PT faces the leading end of the folding blade 88. At this time, the sheet bundle PT has been saddle-stitched. Thus, even if the sheet bundle PT is moved upward so as to be pushed by the end fence 84, the aligned state of the sheet bundle PT hardly disturbed.

Then, as illustrated in FIGS. 4A and 4B, in a state in which the central portion Pm of the sheet bundle PT is folded by the folding blade 88 moving to the left in FIGS. 4A and 4B, the folded portion (central portion Pm) is positioned at the leading end of the sheet bundle PT, and the sheet bundle PT is pressed against the folding blade 88 while being nipped and conveyed by the folding roller pair 89. Thus, the center-folding process on the sheet bundle PT is performed.

As described above, FIG. 5 illustrates a distance W between different positions (height difference) of the end fence 84 when the saddle-stitching process is shifted to the center-folding process. That is, the end fence 84 is located at the position indicated by a lower broken line in FIG. 5 during the saddle-stitching process, and is located at the position indicated by an upper broken line in FIG. 5 above the position by the distance W during the center-folding process.

On the other hand, in the present embodiment, when the center-folding mode, i.e., the second mode is selected, the positions of the end fence 84 and the claw 85 as the aligning device in the sheet conveyance direction are adjusted by the moving mechanism 110 before the sheets P as a target of the center-folding process (second post-process) are received by the end fence 84 and the claw 85.

That is, as illustrated in FIG. 3C, the positions of the end fence 84 and the claw 85 in the vertical direction are moved to optimum positions, which are positions at which the center portion Pm of the sheet P faces the folding position of the center-folding process portion 87, by the moving mechanism 110. After the positions are fixed or the movement the moving mechanism 110 is stopped, the sheet P is received by the end fence 84 and the claw 85 as the aligning device in the center-folding unit 87. After the end fence 84 and the claw 85 as the aligning device including the side fences 86 perform alignment process on the sheet bundle PT in the sheet conveyance direction and the sheet width direction, the center-folding unit 87 performs center-folding process.

As described above, in the present embodiment, when the center-folding mode is performed, after the saddle-stitching process is performed to align the sheet bundle PT at a position at which the saddle-stitching process is performed, i.e., the position in FIG. 3A, the sheet bundle PT is not moved to the position, i.e., the position in FIG. 3C, at which the center-folding process is performed. However, the sheet bundle PT is aligned at the position at which the saddle-stitching process is performed from the start and the center-folding process is continuously performed on the sheet bundle PT. Accordingly, a disadvantage that the sheet bundle PT may not be neatly aligned, i.e., alignment failure, while the sheet bundle PT which has been aligned is moved to the alignment position, can be reduced.

That is, in a case in which only the center-folding process is performed without performing the saddle-stitching process, if the sheet bundle PT that has been aligned at the position at which the saddle-stitching process is performed is moved to the position at which the center-folding process is performed, alignment failure may occur due to the movement of the sheet bundle PT. On the other hand, in the present embodiment, in a case in which only the center-folding process is performed without performing the saddle-stitching process, the center-folding process is performed without moving the sheet bundle PT which has been aligned at the position at which the center-folding process is performed. For this reason, alignment failure is less likely to occur and a favorable state in which the sheet bundle PT is neatly aligned may be obtained.

For this reason, the appearance of the sheet bundle PT after the center-folding process is performed may be less likely to deteriorate.

In particular, in the case in which only the center-folding process is performed without performing the saddle-stitching process, i.e., the center folding mode, the sheet bundle PT is not bound. Thus, alignment or deviation failure due to the movement of the sheet bundle PT is likely to occur. For this reason, such a control as described above is useful.

Further, in the present embodiment, in the case in which only the center-folding process is performed without performing the center binding process, i.e., the center folding mode, the end fence 84 and the claw 85 as the aligning device are positioned at the positions at which the center-folding process is performed from the beginning. Thus, the time to move the end fence 84 and the claw 85 is unnecessary compared with the case in which the end fence 84 and the claw 85 are moved from the position at which the center binding process is performed to the position at which the saddle-stitching process is performed. For this reason, the processing time of the center-folding mode is shortened. Thus, the productivity of the apparatus is enhanced.

In the present embodiment, as described above, the positions of the end fence 84 and the claw 85 as the aligning device in the sheet conveyance direction are adjusted by the moving mechanism 110 in accordance with the size of the sheet P received by the end fence 84 and the claw 85 in the sheet conveyance direction, before the sheet P is received by the end fence 84 and the claw 85. Specifically, in a case in which the alignment process is performed on the sheet P having a large size in the sheet conveyance direction, the moving mechanism 110 is controlled such that the interval between the end fence 84 and the claw 85 in the sheet conveyance direction is longer than an interval of a case in which the alignment process is performed on the sheet P having a small size in the sheet conveyance direction.

In the present embodiment, such control in accordance with the size of the sheet P is performed not only when the alignment operation (sheet alignment process) by the end fence 84 and the claw 85 as the aligning device is performed in the sheet alignment process, but also when the alignment operation (sheet alignment process) by the end fence 84 and the claw 85 is performed in the center-folding mode.

Thus, regardless of the size of the sheet P or the processing mode, post-processing without misalignment of the sheets P can be performed.

Hereinafter, a control flow related to the binding device 80 described above is described below with reference to FIG. 6.

First, when a desired print instruction or desired setting is input through the operation display panel 49 (step S1), it is determined whether the binding mode is set (step S2). As a result, when the binding mode is selected, printing is performed by the image forming apparatus 1 based on the setting input in step S1 (step S3), and the end fence 84 and the claw 85, which serve as the aligning device, are moved to the saddle-stitching position illustrated in FIG. 3A by the moving mechanism 110 (step S4). Thereafter, the printed sheet P that is conveyed into the post-processing apparatus 50 is received by the end fence 84 and the claw 85 that serve as the aligning device (step S5), and sheet alignment operations in the sheet conveyance direction and the sheet width direction are performed by the end fence 84 and the claw 85 including the side fences 86 (step S6). Then, when the sheets P having the number of sheets set in step S1 are stacked and aligned on the end fence 84 and the claw 85 as the aligning device, the saddle-stitching process is performed on the sheets P or the sheet bundle PT by the saddle-stitching device 81 (steps S7 and S8).

When the saddle-stitching process is completed, the moving mechanism 110 moves the sheet bundle PT together with the end fence 84 and the claw 85 that serve as the aligning device including the side fences 86 to the center-folding position illustrated in FIG. 3C (step S9). Then, the center-folding unit 87 performs center-folding process on the sheet bundle PT moved to the center-folding position (step S10), and the book-bound sheet bundle PT is ejected and stacked on the third ejection tray 73 (step S11) (see FIG. 2).

On the other hand, if the binding mode is not selected in step S2, it is determined whether the center-folding mode is selected (step S12).

As a result, when the center-folding mode is selected, printing is performed by the image forming apparatus 1 based on the setting input in step S1 (step S14), and the end fence 84 and the claw 85 as the aligning device are moved to the center-folding position illustrated in FIG. 3C by the moving mechanism 110 on the assumption that the saddle-stitching process is not performed (step S15). Thereafter, the printed sheet P conveyed into the post-processing apparatus 50 is received by the end fence 84 and the claw 85 that serves as the aligning device (step S16), and alignment operations in the sheet conveyance direction and the sheet width direction are performed by the end fence 84 and the claw 85 including the side fences 86 (step S17). When the sheets P having the number of sheets set in step S1 are stacked and aligned on the end fence 84 and the claw 85 as the aligning device, the center-folding unit 87 performs center-binding process on the sheets P (sheet bundle PT) (step S10). Thereafter, the center-folded sheet bundle PT is ejected and stacked on the third ejection tray 73 (see FIG. 2) (step S11).

If the center-folding mode is not selected in step S12, another process not involving the binding mode or the center-folding mode is performed based on the setting input in step S1 (step S13).

First Modification

In a first modification of the above embodiments of the present disclosure, the positions of the end fence 84 and the claw 85 as the aligning device in the sheet conveyance direction are adjusted by the moving mechanism 110 before the sheets P are received in accordance with the number of sheets P received by the end fence 84 and the claw 85.

Figure 7A:
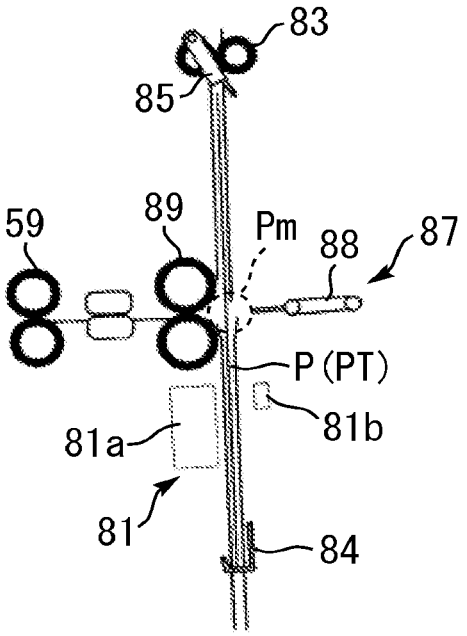
FIGS. 7A, 7B, and 7C are schematic diagrams each illustrating a relevant part of a post-processing apparatus according to a first modification of the above embodiments of the present disclosure.

FIG. 7A is a schematic diagram illustrating the center-folding unit 87 in a state in which immediately before the center-folding unit 87 performs center-folding process on the sheet P or the sheet bundle PT whose position in the sheet conveyance direction has been adjusted by the end fence 84 and the claw 85 that serve as the aligning device. At this time, as illustrated in FIG. 7C, when a large number of sheets P or the sheet bundle PT are received by the end fence 84 and the claw 85 as the aligning device, the sheets P hardly bend. However, as illustrated in FIG. 7B, when a small number of sheets P (one sheet P in FIG. 7B) are received by the end fence 84 and the claw 85 as the aligning device, the sheets P is likely to bend between the guide plates forming the conveyance path.

Figure 7B:
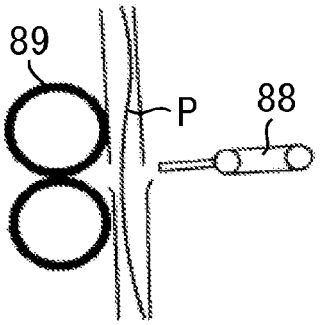
Figure 7C:
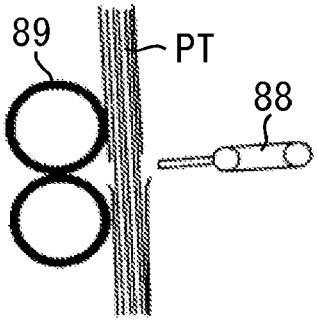

As illustrated in FIG. 7B, if the center-folding process is performed in a state in which the sheet P is bent and abuts against the end fence 84 located at the same position as in FIG. 7C, the center-folding process is performed in a state in which the central portion Pm of the sheet P is shifted downward. That is, the center portion Pm of the sheet P is not be center-folded. Such a phenomenon occurs not only in the center-folding process but also in the saddle-stitching process.

For this reason, in the first modification of the above embodiments of the present disclosure, the position of the end fence 84 as the aligning device is adjusted such that the position at which the center-folding process or the binding process is performed is higher when the number of sheets P received by the end fence 84 and the claw 85 as the aligning device is small than when the number of sheets P is large.

Thus, regardless of the number of sheets P received by the end fence 84 and the claw 85, the binding mode and the center-folding mode can be favorably performed without displacing the positions at which the binding mode and the center-folding mode is performed.

The number of sheets P received by the end fence 84 and the claw 85 as the aligning device can be grasped by the controller 100 based on information of a counter 112 (see FIG. 2) that counts the number of conveyed sheets, or can be grasped by the controller 100 based on printing conditions input to the operation display panel 49 (see FIGS. 1 and 2).

Second Modification

In a second modification of the above embodiments of the present disclosure, the moving mechanism 110 is controlled such that the position of the end fence 84 as the alignment device in the sheet conveyance direction when the center-folding process is executed in the center-folding mode, i.e., the second mode, is at an upstream side (upper side) of the position of the end fence 84 as the alignment device in the sheet conveyance direction when the center-folding process is executed in the binding mode, i.e., the first mode.

Figure 8A:
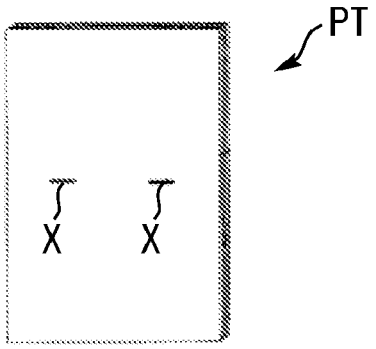
FIGS. 8A, 8B, 8C, and 8D are schematic diagrams illustrating a sheet bundle that is not yet folded and a state in which the sheet is positioned in a center-folding unit according to a second modification of the above embodiments of the present disclosure.

This is because the sheets P of the sheet bundle PT (see FIG. 8C) that has not yet saddle-stitched, are not bound to each other and are more likely to bend than the sheet bundle PT (see FIG. 8A) that has been saddle-stitched.

Figure 8B:
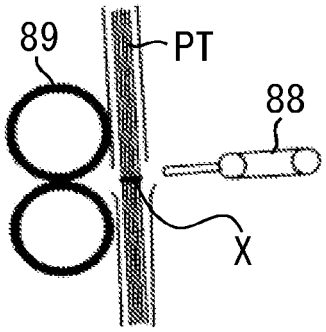
Figure 8C:
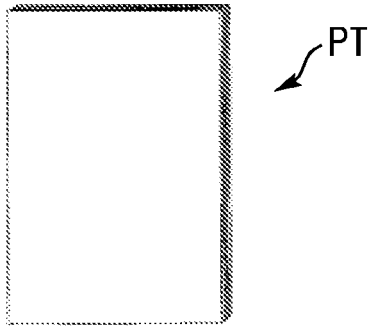
Figure 8D:
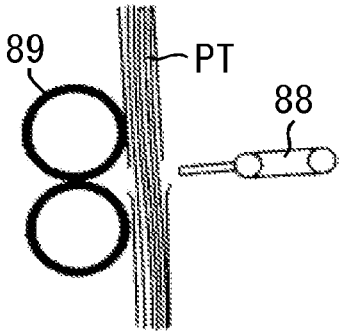

For this reason, in the second modification of the above embodiments of the present disclosure, the position of the end fence 84 as the alignment device is adjusted so that the position for performing the center-folding process or the binding process is located at an upper side when the center-folding process is performed on the sheet bundle PT that has not gone through the center-binding process as illustrated in FIG. 8D compared to a case in which the center-folding process is performed on the sheet bundle PT that has gone through the center-binding process as illustrated in FIG. 8B.

Such a configuration allows to favorably perform the center-folding mode without shifting the position regardless of the presence or absence of the saddle stitch process.

Third Modification

Figure 9A:
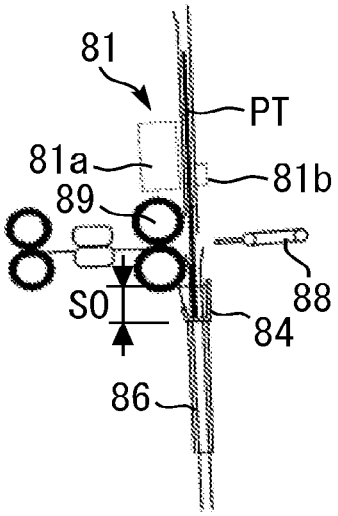
FIGS. 9A and 9B are schematic diagrams each illustrating a relevant part of a post-processing apparatus according to a third modification of the above embodiments of the present disclosure.
Figure 9B:
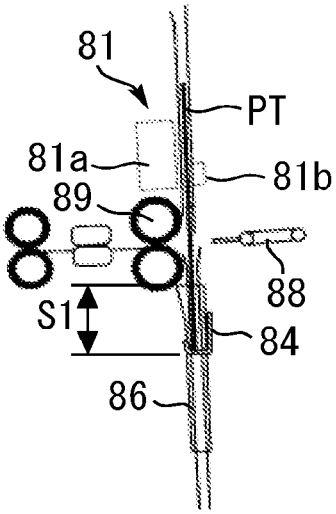

As illustrated in FIGS. 9A and 9B, in the binding device 80 of the post-processing apparatus 50 according to a third modification of the above embodiments of the present disclosure, the position of the end fence 84 in the vertical direction is fixed so that the side fences 86 do not move up and down together with the end fence 84 as the alignment device. In the third modification of the above embodiments of the present disclosure, the saddle-stitching device 81 is disposed upstream (above) the center-folding unit 87.

If the vertical position of the side fences 86 is fixed as in the third modification of the above embodiments of the present disclosure, as can be recognized from a comparison between FIGS. 9A and 9B, a vertical length S of the side fences 86 that can contact the sheet bundle PT varies depending on the vertical position of the end fence 84 (S0<S1). If the length S in the vertical direction in which the side fences 86 can come into contact with the sheet bundle PT is too short, the function of the side fences 86 for aligning the position of the sheet bundle PT in the sheet width direction is not sufficiently exhibited.

For this reason, in a case in which the positions of the side fences 86 in the sheet conveyance direction are fixed, it is necessary to optimize the relative position at which the alignment process is performed by the side fences 86 based on the relationship with the center-folding position in the center-folding unit 87 and the saddle-stitching position in the saddle-stitching device 81.

Fourth Modification

In a fourth modification of the above embodiments of the present disclosure, at least when the center-folding process is executed in the center-folding mode, i.e., the second mode, a pressing speed V2 of the sheet P or the sheet bundle PT by the folding blade 88 is set to be equal to or higher than a conveyance speed V1 of the sheet P or the sheet bundle PT by the folding roller pair 89 (V1≤V2).

Figure 10A:
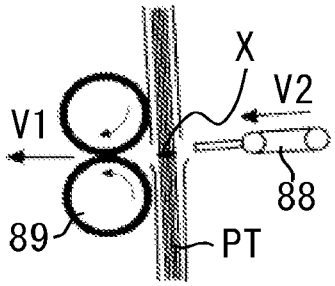
FIGS. 10A, 10B, 10C, 10D and 10E are schematic diagrams each illustrating a relevant part of a post-processing apparatus according to a fourth modification of the above embodiments of the present disclosure.
Figure 10B:
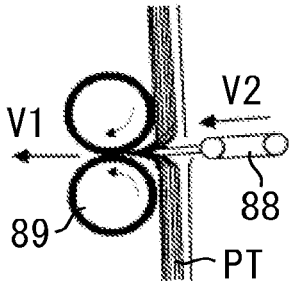

As illustrated in FIGS. 10A and 10B, when the center-folding process is performed in the binding mode, the sheet bundle PT as a target of the center-folding process is saddle-stitched by the staples X and the sheets P are bound to each other, the favorable center-folding process without deviation can be performed regardless of the magnitude relationship between the conveying speed V1 of the folding roller pair 89 and the pressing speed V2 of the folding blade 88.

Figure 10C:
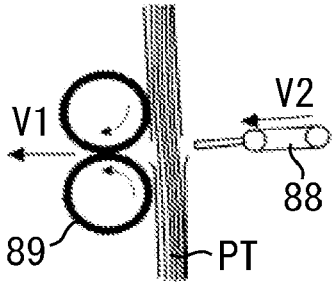
Figure 10D:
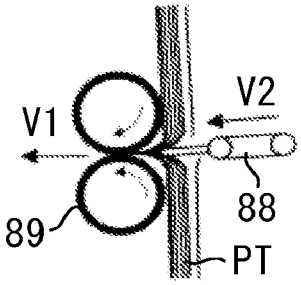
Figure 10E:
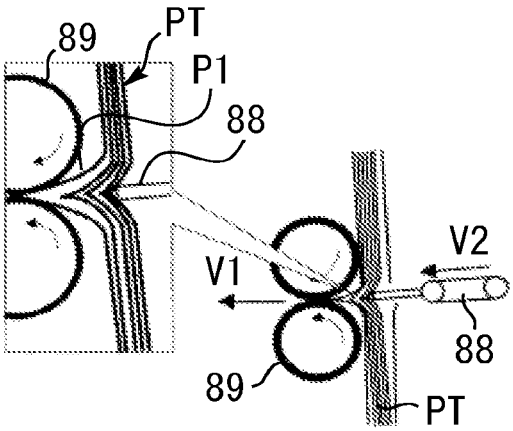

On the other hand, as illustrated in FIGS. 10C and 10D, when the center-folding mode is performed, the sheet bundle P as a target of the center-folding process is not saddle-stitched by the staples X and the sheets P are not bound to each other. Thus, the appearance after the center-folding process greatly differs depending on the magnitude relationship between the conveying speed V1 of the folding roller pair 89 and the pressing speed V2 of the folding blade 88. Specifically, as illustrated in FIGS. 10C and 10E, if the conveying speed V1 of the folding roller pair 89 is higher than the pushing speed V2 of the folding blade 88 (V1>V2), a sheet P1 closest to the nip of the folding roller pair 89 in the sheet bundle P is drawn into the folding roller pair 89 to cause a shift between the sheets P, thereby deteriorating the appearance after the center-folding process. On the other hand, as illustrated in FIGS. 10C and 10D, when the pressing speed V2 of the folding blade 88 is equal to or higher than the conveying speed V1 of the folding roller pair 89 (V1≤V2), the sheet P1 in the vicinity of the nip of the folding roller pair 89 is not drawn into the folding roller pair 89 as described above, the deviation between the sheets P does not occur. Accordingly, the appearance after the center-folding process is favorable.

Therefore, preferably, the pressing speed V2 of the folding blade 88 to be equal to or higher than the conveying speed V1 of the folding roller pair 89 in advance to avoid the labor of complicated adjustment of the pressing speed V2 of the folding blade 88 and the conveying speed V1 of the folding roller pair 89 for each mode.

Fifth Modification

In a fifth modification of the above embodiments of the present disclosure, the position of the end fence 84 as the aligning device in the sheet conveyance direction is adjusted by the moving mechanism 110 before the sheets P is received by the end fence 84 and the claw 85 that serve as the aligning device in accordance with at least one of thickness, rigidity, crease, and gap of the sheets P received by the end fence 84 and the claw 85.

This is because the thinner the thickness of the sheet P, the weaker the rigidity of the sheets P is, the more easily the sheets P is more likely to bend. Further, this is because there is a difference in the degree of bending of the sheets P depending on the type or crease of the sheets P and the difference in the gap of the sheets P.

Figure 11A:
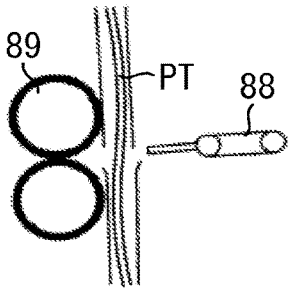
FIGS. 11A and 11B are schematic diagrams illustrating a relevant part of a post-processing apparatus according to a fifth modification of the above embodiments of the present disclosure.
Figure 11B:
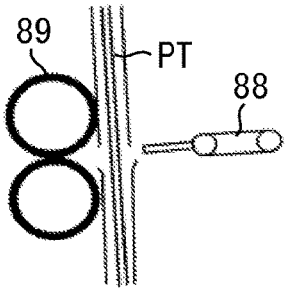

As illustrated in FIG. 11A, when the sheet bundle PT is largely bent between the guide plates that form the conveyance path, and the center-folding process is performed on the sheet bundle PT that abuts against the end fence 84 at the same position as in FIG. 11B in which the sheet P is not bent, the center-folding process is performed in a state in which the center portion Pm of the sheet P is shifted downward. That is, the center portion Pm of the sheet P is not be center-folded. Such a phenomenon occurs not only in the center-folding process but also in the saddle-stitching process.

Therefore, in the fifth modification of the above embodiments of the present disclosure, when the thickness of the sheet P to be received is smaller than a predetermined value, when the rigidity of the sheet P to be received is smaller than a predetermined threshold value, or when a specific type of sheets P is received, when the sheets P formed with a specific crease are received, the position of the end fence 84 as the aligning device is adjusted so that the position for performing the center-folding process or the binding process is located at an upper side than in other cases.

For this reason, regardless of the thickness, rigidity, crease, and texture of the sheet P, the binding mode and the folding mode can be favorably performed without shifting the position.

Note that the thickness, rigidity, type, and crease of the sheets P received by the end fence 84 and the claw 85 as the aligning device can be grasped by the controller 100 based on printing conditions input to the operation display panel 49 (see FIGS. 1 and 2).

Further, in the fifth modification of the above embodiments of the present disclosure, the position of the end fence 84 as the aligning device in the sheet conveyance direction is adjusted by the moving mechanism 110 before the sheet P is received by the aligning device in accordance with at least one of the ambient temperature and humidity.

This is because the sheet P is more likely to bend as the ambient humidity increases and the moisture content of the sheet P increases and as the ambient temperature increases. In particular, the ambient humidity greatly affects the degree of bending of the sheets P.

For this reason, in the fifth modification of the above embodiments of the present disclosure, when the ambient humidity is higher than the predetermined humidity or when the ambient temperature is higher than the predetermined temperature, the position of the end fence 84 as the alignment device is adjusted such that the position at which the center-folding process or the binding process is performed is located at an upper side than in other cases.

Thus, regardless of the surrounding environment, the binding mode and the center-folding mode can be favorably performed without shifting the position.

The ambient temperature and humidity can be grasped by the controller 100 based on the detection result of the temperature and humidity sensor 111 (see FIGS. 1 and 2).

In addition, in the fifth modification of the above embodiments of the present disclosure, the position of the end fence 84 as the aligning device can be finely adjusted in multiple stages according to the degree of bending of the sheet P, i.e., according to the thickness or rigidity value of the sheet P value of the sheet P.

Sixth Modification

In a sixth modification of the above embodiments of the present disclosure, when the binding mode as the first mode is selected for one sheet P, the binding mode as the first mode is stopped for the one sheet P and the center-folding mode as the second mode is performed on the one sheet P.

The user may operate the operation display panel 49 (see FIG. 1) to select an "combined mode" in which the image data of a plurality of documents D is combined and printed on one sheet P. In such a case, if the binding mode is selected in parallel, the binding mode is tried to be performed on one sheet P. Thus, the sheet P is aligned at the saddle-stitching position (the position of FIG. 3A) and then moved to the center-folding position by the moving mechanism 110 as a target of the center-folding process, and the above-described disadvantage due to the movement (particularly, the process time) occurs. In such a case, it is not necessary to perform the saddle-stitching process on one sheet P. Thus, in the fifth modification of the above embodiments of the present disclosure, control is performed such that the center-folding mode is executed on one sheet P.

Figure 6:
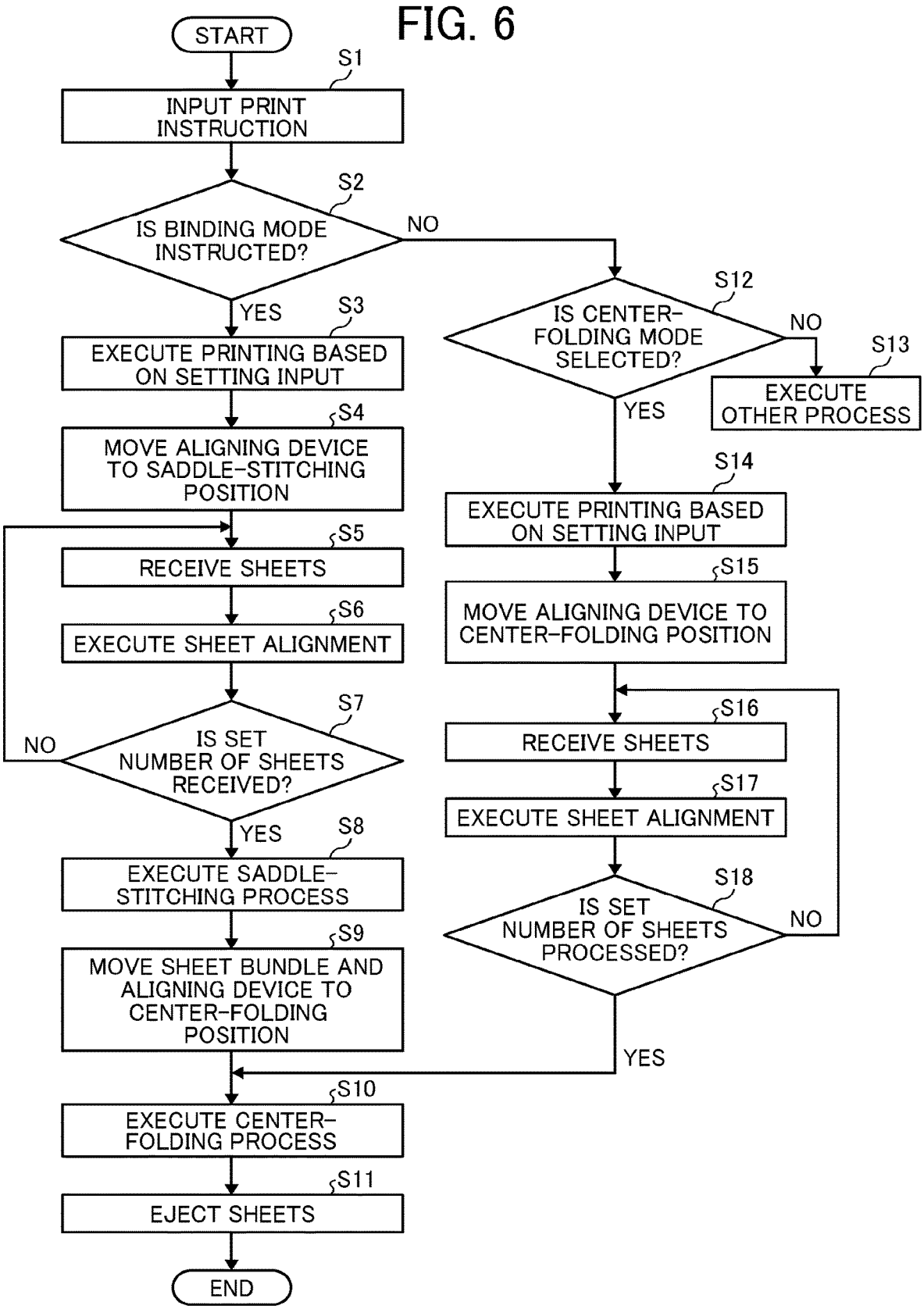
FIG. 6 is a flowchart of the control processes performed by a post-processing apparatus according to an embodiment of the present disclosure.
Figure 12:
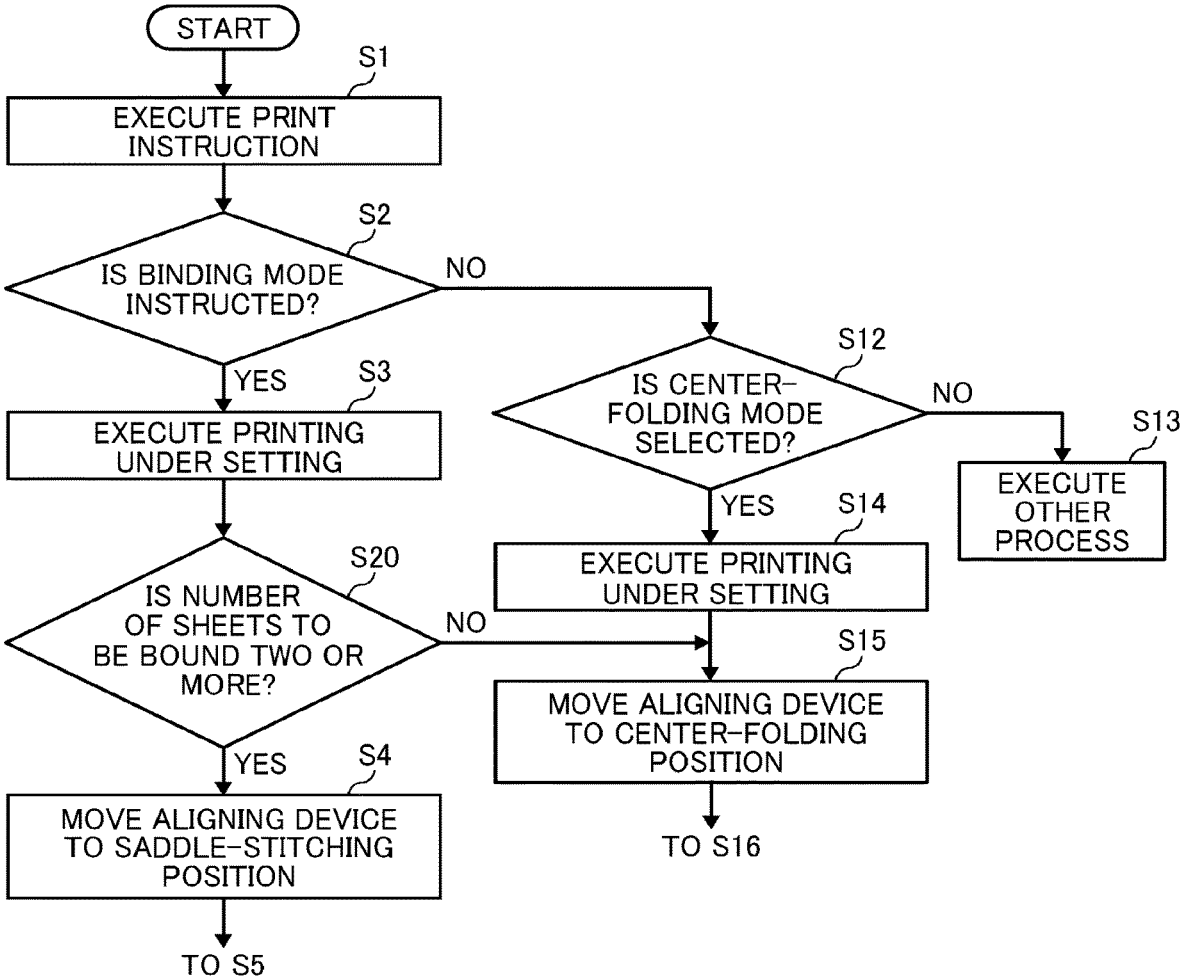
FIG. 12 is a flowchart of the control processes performed by a post-processing apparatus according to a sixth modification of the above embodiments of the present disclosure.

Specifically, as illustrated in the flowchart of FIG. 12, which is obtained by adding step S20 to the flowchart of FIG. 6, after the binding mode is selected in step S2 and the print is executed under the setting (steps S1 to S3), it is determined whether the number of sheets P to be processed, i.e., the number of bound sheets, is equal to or greater than two (step S20). As a result, when the number of sheets P is equal to or greater than two, the flow after step S4 in the normal binding mode is performed. On the other hand, when the number of sheets P is one in step S20, the end fence 84 and the claw 85 as the aligning device are moved in accordance with the center-folding position (step S15), and the flow after step S15 in the center-folding mode is performed.

As described above, the edge-binding device 90 and the binding device 80 according to the present embodiment include the end fence 84 and the claw 85 as the aligning device that receive the sheets P conveyed in a predetermined conveyance direction in a stackable manner and align the positions of the sheets P in the sheet conveyance direction. In addition, the moving mechanism 110 that can move the sheets P aligned by the end fence 84 and the claw 85 as the aligning device in the sheet conveyance direction together with the end fence 84 and the claw 85 as the aligning device is provided. In addition, either a binding mode (first mode) in which center-folding process, i.e., the second post-processing is performed after center-binding process, i.e., the first post-processing is performed on the sheets P, or a center-folding mode, i.e., the second mode in which center-folding process is performed without performing center-binding process on the sheets P can be selected. When the binding mode is selected, the positions of the end fence 84 and the claw 85 as the aligning device in the sheet conveyance direction are adjusted by the moving mechanism 110 before the sheets P as a target of the saddle-stitching process are received. When the center-folding mode is selected, the positions of the end fence 84 and the claw 85 as the aligning device in the sheet conveyance direction are adjusted by the moving mechanism 110 before the sheets P as a target of the center-folding process are received.

Owing to this mechanism, when a predetermined post-processing is performed among a plurality of post-processes, i.e., the saddle-stitching process and the center-folding process, alignment failure is less likely to occur.

In this embodiment, the present disclosure is applied to the post-processing apparatus 50 connected to the monochrome image forming apparatus 1. However, the present disclosure can also be applied to a post-processing apparatus connected to a color image forming apparatus.

Further, in the embodiments described above, the present disclosure is applied to the post-processing apparatus 50 connected to the monochrome image forming apparatus 1 that employs electrophotography. However, the present disclosure is not limited to a post-processing apparatus connected to an image forming apparatus that employs electrophotography. The present disclosure can also be applied to a post-processing apparatus connected to an image forming apparatus of another type (for example, an ink jet image forming apparatus or a stencil printing machine).

Further, the present disclosure can be applied not only to the post-processing apparatus 50 connected to the image forming apparatus 1 but also to a post-processing apparatus as a single apparatus. For example, the present disclosure can be applied to a post-processing apparatus in which a sheet feed cassette is set onto the carry-in port 50*a*, and an operation display panel for inputting a processing mode or the like is installed in the post-processing apparatus itself.

Any of the cases described above exhibit effects similar to those of the above-described embodiments of the present disclosure.

Further, in the embodiments described above, the present disclosure is applied to the post-processing apparatus 50 capable of performing the edge binding process, the sorting process, the saddle-stitching process, the center-folding process, and the punching process. However, the present disclosure is not limited to the above-described configuration and the present disclosure can be applied to a post-processing apparatus that performs two kinds of post processing, for example, the saddle-stitching process and the center-folding process.

Further, in the embodiments described above, the present disclosure is applied to the post-processing apparatus 50 in which the first post-processing is the saddle-stitching process and the second post-processing is the center-folding process. However, the post-processing apparatus to which the present disclosure is applied is not limited to such a configuration and the present disclosure can be applied to any apparatus as long as the first post-processing and the second post-processing are continuously performed by moving aligning devices.

Any of the cases described above exhibit effects similar to those of the above-described embodiments of the present disclosure.

Note that the above-described embodiments are illustrative and do not limit the present disclosure. It is therefore to be understood that within the scope of the present disclosure, the present disclosure may be practiced otherwise than as specifically described herein. The number, position, and shape of the components described above are not limited to those embodiments described above. Desirable number, position, and shape can be determined to perform the present disclosure.

In this specification and the like, the term "sheet" is defined to include not only paper but also all sheet-shaped members as a target of the post processes.

In the above descriptions, the term "printing" in the present disclosure may be used synonymously with, e.g. the terms of "image formation", "recording", "printing", and "image printing".

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present disclosure.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A post-processing apparatus comprising:

an aligner to receive a sheet conveyed in a sheet conveyance direction in a stackable manner and align a position of the sheet in the sheet conveyance direction;

a mover to move the sheet aligned by the aligning device in the sheet conveyance direction together with the aligning device; and a controller configured to selectively execute a first mode in which first post-processing is performed on the sheet and then second post-processing is performed on the sheet and a second mode in which the second post-processing is performed on the sheet without performing the first post-processing on the sheet, the controller being configured to, in response to a selection of the first mode, cause the mover to adjust a position of the aligner in the sheet conveyance direction before the aligner receives the sheet as a target of the first post-processing, and the controller being configured to, in response to a selection of the second mode, cause the mover to adjust the position of the aligner in the sheet conveyance direction before the aligner receives the sheet as a target of the second post-processing, wherein the first post-processing is saddle stitching for stitching central portions of a plurality of sheets, wherein the second post-processing is center folding for folding a central portion of the sheet, and wherein the controller is configured to, in response to a selection of a binding mode as the first mode for one sheet, stop the first mode and perform the center folding on the one sheet as the second mode.

2. The post-processing apparatus according to claim 1, wherein the controller is configured to, in response to the selection of the first mode, cause the mover to move the sheet together with the aligner after the first post-processing is performed on the sheet received and aligned by the aligner and before the second post-processing is performed on the sheet.

3. The post-processing apparatus according to claim 1, further comprising:

a folding blade to press the central portion of the sheet when the center folding is performed; and a folding roller pair to convey the sheet while nipping the sheet, with the center portion of the sheet pressed by the folding blade being a leading portion in the sheet conveyance direction, wherein the controller is configured to cause a sheet pressing speed of the folding blade to be equal to or higher than a sheet conveyance speed of the folding roller pair at least when the center folding is performed in the second mode.

4. The post-processing apparatus according to claim 1, wherein the controller is configured to cause the mover to adjust the position of the aligner in the sheet conveyance direction in accordance with a size of the sheet received by the aligner in the sheet conveyance direction before the aligner receives the sheet.

5. The post-processing apparatus according to claim 1, wherein the controller is configured to cause the mover moving to adjust the position of the aligner in the sheet conveyance direction in accordance with at least one of a thickness, a rigidity, a type, and a crease of the sheet received by the aligner before the aligner receives the sheet.

6. The post-processing apparatus according to claim 1, wherein the aligner includes:

an end fence against which a leading end of the sheet in the sheet conveyance direction abuts; and a claw to push a rear end of the sheet in the sheet conveyance direction toward the end fence in a state in which the rear end of the sheet abuts against the end fence, wherein the controller is configured to cause the mover to move the end fence and the claw in the sheet conveyance direction.

7. An image forming system comprising:

an image forming apparatus to form an image on a sheet; and the post-processing apparatus according to claim 1 to perform post-processing on the sheet on which the image has been formed by the image forming apparatus.

8. A post-processing apparatus comprising:

an aligner to receive a sheet conveyed in a sheet conveyance direction in a stackable manner and align a position of the sheet in the sheet conveyance direction;

a mover to move the sheet aligned by the aligning device in the sheet conveyance direction together with the aligning device; and a controller configured to selectively execute a first mode in which first post-processing is performed on the sheet and then second post-processing is performed on the sheet and a second mode in which the second post-processing is performed on the sheet without performing the first post-processing on the sheet, the controller being configured to, in response to a selection of the first mode, cause the mover to adjust a position of the aligner in the sheet conveyance direction before the aligner receives the sheet as a target of the first post-processing, and the controller being configured to, in response to a selection of the second mode, cause the mover to adjust the position of the aligner in the sheet conveyance direction before the aligner receives the sheet as a target of the second post-processing, wherein the first post-processing is saddle stitching for stitching central portions of a plurality of sheets, wherein the second post-processing is center folding for folding a central portion of the sheet, and wherein the controller is configured to control the mover such that a position of the aligner in the sheet conveyance direction when the center folding is performed in the second mode is placed upstream in the sheet conveyance direction from a position of the aligner in the sheet conveyance direction when the center folding is performed in the first mode.

9. The post-processing apparatus according to claim 8, wherein the controller is configured to, in response to the selection of the first mode, cause the mover to move the sheet together with the aligner after the first post-processing is performed on the sheet received and aligned by the aligner and before the second post-processing is performed on the sheet.

10. The post-processing apparatus according to claim 8, further comprising:

a folding blade to press the central portion of the sheet when the center folding is performed; and a folding roller pair to convey the sheet while nipping the sheet, with the center portion of the sheet pressed by the folding blade being a leading portion in the sheet conveyance direction, wherein the controller is configured to cause a sheet pressing speed of the folding blade to be equal to or higher than a sheet conveyance speed of the folding roller pair at least when the center folding is performed in the second mode.

11. The post-processing apparatus according to claim 8, wherein the controller is configured to cause the mover to adjust the position of the aligner in the sheet conveyance direction in accordance with a size of the sheet received by the aligner in the sheet conveyance direction before the aligner receives the sheet.

12. A post-processing apparatus comprising:

an aligner to receive a sheet conveyed in a sheet conveyance direction in a stackable manner and align a position of the sheet in the sheet conveyance direction;

a mover to move the sheet aligned by the in the sheet conveyance direction together with the aligning device; and a controller configured to selectively execute a first mode in which first post-processing is performed on the sheet and then second post-processing is performed on the sheet and a second mode in which the second post-processing is performed on the sheet without performing the first post-processing on the sheet, the controller being configured to, in response to a selection of the first mode, cause the mover to adjust a position of the aligner in the sheet conveyance direction before the aligner receives the sheet as a target of the first post-processing, and the controller being configured to, in response to a selection of the second mode, cause the mover to adjust the position of the aligner in the sheet conveyance direction before the aligner receives the sheet as a target of the second post-processing, wherein the controller is configured to cause the mover to adjust the position of the aligner in the sheet conveyance direction in accordance with a number of sheets received by the aligner before the aligner receives the sheet.

13. The post-processing apparatus according to claim 12, wherein the controller is configured to, in response to the selection of the first mode, cause the mover to move the sheet together with the aligner after the first post-processing is performed on the sheet received and aligned by the aligner and before the second post-processing is performed on the sheet.

14. The post-processing apparatus according to claim 12, further comprising:

a folding blade to press the central portion of the sheet when the center folding is performed; and a folding roller pair to convey the sheet while nipping the sheet, with the center portion of the sheet pressed by the folding blade being a leading portion in the sheet conveyance direction, wherein the controller is configured to cause a sheet pressing speed of the folding blade to be equal to or higher than a sheet conveyance speed of the folding roller pair at least when the center folding is performed in the second mode.

15. A post-processing apparatus comprising:

an aligner to receive a sheet conveyed in a sheet conveyance direction in a stackable manner and align a position of the sheet in the sheet conveyance direction;

a mover to move the sheet aligned by the in the sheet conveyance direction together with the aligning device; and a controller configured to selectively execute a first mode in which first post-processing is performed on the sheet and then second post-processing is performed on the sheet and a second mode in which the second post-processing is performed on the sheet without performing the first post-processing on the sheet, the controller being configured to, in response to a selection of the first mode, cause the mover to adjust a position of the aligner in the sheet conveyance direction before the aligner receives the sheet as a target of the first post-processing, and the controller being configured to, in response to a selection of the second mode, cause the mover to adjust the position of the aligner in the sheet conveyance direction before the aligner receives the sheet as a target of the second post-processing, wherein the controller is configured to cause the mover to adjust the position of the aligner in the sheet conveyance direction in accordance with at least one of ambient temperature and ambient humidity before the aligner receives the sheet.

16. The post-processing apparatus according to claim 15, wherein the controller is configured to, in response to the selection of the first mode, cause the mover to move the sheet together with the aligner after the first post-processing is performed on the sheet received and aligned by the aligner and before the second post-processing is performed on the sheet.

17. The post-processing apparatus according to claim 15, further comprising:

a folding blade to press the central portion of the sheet when the center folding is performed; and a folding roller pair to convey the sheet while nipping the sheet, with the center portion of the sheet pressed by the folding blade being a leading portion in the sheet conveyance direction, wherein the controller is configured to cause a sheet pressing speed of the folding blade to be equal to or higher than a sheet conveyance speed of the folding roller pair at least when the center folding is performed in the second mode.

18. A post-processing apparatus comprising:

an aligner to receive a sheet conveyed in a sheet conveyance direction in a stackable manner and align a position of the sheet in the sheet conveyance direction;

a mover to move the sheet aligned by the in the sheet conveyance direction together with the aligning device; and a controller configured to selectively execute a first mode in which first post-processing is performed on the sheet and then second post-processing is performed on the sheet and a second mode in which the second post-processing is performed on the sheet without performing the first post-processing on the sheet, the controller being configured to, in response to a selection of the first mode, cause the mover to adjust a position of the aligner in the sheet conveyance direction before the aligner receives the sheet as a target of the first post-processing, and the controller being configured to, in response to a selection of the second mode, cause the mover to adjust the position of the aligner in the sheet conveyance direction before the aligner receives the sheet as a target of the second post-processing, wherein the aligner further includes a side fence to move in a width direction orthogonal to the sheet conveyance direction to align a position of the sheet in the sheet width direction, and wherein the controller is configured to cause the mover to move the side fence in the sheet conveyance direction.

19. The post-processing apparatus according to claim 18, wherein the controller is configured to, in response to the selection of the first mode, cause the mover to move the sheet together with the aligner after the first post-processing is performed on the sheet received and aligned by the aligner and before the second post-processing is performed on the sheet.

20. The post-processing apparatus according to claim 18, further comprising:

a folding blade to press the central portion of the sheet when the center folding is performed; and a folding roller pair to convey the sheet while nipping the sheet, with the center portion of the sheet pressed by the folding blade being a leading portion in the sheet conveyance direction, wherein the controller is configured to cause a sheet pressing speed of the folding blade to be equal to or higher than a sheet conveyance speed of the folding roller pair at least when the center folding is performed in the second mode.

* * * * *